US005615658A

United States Patent [19]

Hashimoto

[11] Patent Number: 5,615,658

[45] Date of Patent: Apr. 1, 1997

[54] COMBUSTION AIR QUALITY IMPROVING DEVICE FOR INTERNAL COMBUSTION ENGINE OR GENERAL COMBUSTION EQUIPMENT

[76] Inventor: Akira Hashimoto, 4-26-308, Takanawa 1-chome, Minato-ku, Tokyo 108, Japan

[21] Appl. No.: 406,915

[22] PCT Filed: Oct. 13, 1993

[86] PCT No.: PCT/JP93/01466

§ 371 Date: Mar. 27, 1995

§ 102(e) Date: Mar. 27, 1995

[87] PCT Pub. No.: WO95/10702

PCT Pub. Date: Apr. 20, 1995

[51] Int. Cl.[6] ..... F02M 27/04

[52] U.S. Cl. ..... 123/539

[58] Field of Search ..... 123/536, 537, 123/539; 431/1

[56] References Cited

U.S. PATENT DOCUMENTS

| | | | |
|---|---|---|---|
| 3,830,621 | 8/1974 | Miller | 123/539 |
| 4,461,262 | 7/1984 | Chow | 123/539 |
| 5,329,910 | 7/1994 | Tanaka | 123/539 |
| 5,331,807 | 7/1994 | Hricak | 123/539 |

*Primary Examiner*—Marguerite McMahon
*Attorney, Agent, or Firm*—Tilton, Fallon, Lungmus & Chestnut

[57] ABSTRACT

A box-shaped casing 1, made of magnetic materials, is provided with an air inlet 5 on one end face and with an outlet 6 on the other end face in t front-to-back direction, has an air duct 8 communicating said inlet 5 with said outlet 6 formed inside thereof, and is fixed so as to have the outlet connected to an intermediate point of the suction air duct for combustion air in internal combustion engines or general combustion equipment. In the casing 1, permanent magnets 13 are fixed with the same poles opposed to each other so as to sandwich said air duct 8 therebetween. A plurality of shaft members made of magnetic materials 11 are transversely disposed in the air duct, and are ensleaved by first cylindrical members 16 and second cylindrical members 15 made of metals different in ionization tendency are fitted loosely with a gap between each other. These cylindrical members 15, 16 are freely moved due to the air flow passing through the air duct. During idling of internal combustion engines, for example, air may be forced fed into from the air inlet 5 via a fan motor 30. Within the air duct 8, a strong magnetic field is formed and metal ions are mixed into combustion air from the cylindrical members 11. Further, oxygen in combustion air is qualitatively converted into nascent oxygen on occurrence of electric discharge.

8 Claims, 6 Drawing Sheets

COMBUSTION AIR QUALITY IMPROVING DEVICE FOR INTERNAL COMBUSTION ENGINE OR GENERAL COMBUSTION EQUIPMENT

FIELD OF THE INVENTION

The invention refers to a combustion air improving device that promotes the combustion efficiency of internal combustion engines or general combustion equipment such as boiler and incinerator, thereby contributing to the purification of exausted gas.

BACKGROUND OF THE INVENTION

Techniques adopted generally to promote the combustion efficiency of internal combustion engines, are computer-aided combustion conditions control techniques, such as electronic fuel injection system and electronic control addition system.

In an attempt to raise the combustion efficiency, another technique has recently been proposed which makes a cluster of fuel particles finer by use of electrical stimulus, ultrasonic radiation, or UV illumination, reducing the viscosity of fuel along with enhancing its sprayability. There is, however, a problem of expensiveness in computer control not only because the single device itself is costly but also because a simultaneous installment of treatment means for purification of exausted gas forces is frequently employed. In addition, the computer-aided techniques are not free from fear of failures in the electronic circuit.

On the other hand, the prior art for quality improvement of fuels involves too many unstable factors in practical use: e.g. The action becomes indefinite depending on some combustion conditions or some fuel types. The improved effect is lost prior to suction of air into the combustion chamber.

With these problems of prior art in mind, therefore, it is the primary object of the present invention to provide a device for enhancement of combustion efficiency and for purification of exausted gas by improving the quality of combustion air.

Also, it is another object of the present invention to provide a combustion air quality improving device for internal combustion engines or general combustion equipment that can be produced at a low cost and ensures enhancement of the combustion efficiency regardless of fuel types.

Further, it is still another object of the present invention to provide a combustion air quality improving device for internal combustion engines or general combustion equipment that enables a stable action to be expected almost permanently.

DISCLOSURE OF THE INVENTION

A device according to the present invention is equipped with a casing made of magnetic materials in a shape of an elongated box. The casing has an air inlet on one end face and an outlet on the other end face in the front-to-back or longitudinal direction, an air duct communicating the inlet with the outlet is formed inside thereof, and is used in such a manner of having the outlet fixedly connected to an intermediate point of the suction air duct for combustion air in internal combustion engines or general combustion equipment. In the casing, permanent magnets are fixed with the same poles opposed to each other so as to sandwich said air duct therebetween. Also, shaft members made of magnetic materials are transversely disposed in the air duct. Further, around the shaft members, first and second cylindrical members made of metals different in ionization tendency are fitted loosely with a gap between each other. These cylindrical members are freely moved due to the air flow passing through the air duct. During idling of internal combustion engines, for example, air may be forced into the device from the air inlet via a fan motor.

Within the air duct, consequently, a strong magnetic field is formed in a direction perpendicular to the flow of combustion air under cooperative action of the permanent magnets together with supporting shafts that are magnetized through the casing wall by the magnetic force of these permanent magnets. The magnetic field is made still firmer by covering all other surfaces than the surfaces of the permanent magnets facing to the air duct and those opposite thereto with magnetic insulation members.

First and second cylindrical members loosely inserted through around the supporting shafts are also situated within said magnetic field. The cylindrical members move in such a manner to vibrate violently in the radial, axial, or circumferential direction of their respective supporting shafts. Slantwise fixation of the present device so that the end face on the outlet side may come above the end face on the inlet side concentrates gaps formed between the electrodes and the supporting shafts concentrates in a direction against the flow of air, thereby enhancing the free movement of first and second cylindrical members due to the flow of air still more.

The metallic cylindrical members, freely moved within a magnetic field, are charged by electromagnetic interaction. At this time, the opposed faces of second and first cylindrical members are differently charged to positive and negative poles unless otherwise in contact with each other. Thus, both cylindrical members induce an instantaneous discharge therebetween, when having the opposed faces approaching to each other to a position where a required gap formed, during violent movement while causing the exposed faces to come into contact or get separated.

In combustion air passing through such a magnetic field, oxygen is partly converted to nascent oxygen, or activated oxygen. Because of its stronger oxidizing force than that of normal oxygen, nascent oxygen will elevate the combustion speed when fed from the outlet of a casing through the suction air duct into the combustion chamber, promoting the combustion efficiency.

On the other hand, as being made of metals different in ionization tendency, second and first cylindrical members will generate ions different from each other (positive and negative ions) during discharge in a strong magnetic field. These ionized metal particles are mixed into combustion air, some kinds of the metals serve as combustion catalyzers corresponding to individual kinds of fuels, respectively, thereby leading the burning in combustion air to a condition near to a complete one.

With oxygen in combustion air, mixing of a metallic ion as combustion catalyzer and action of activated oxygen mentioned above are combined to not only suppress an increase in temperature during burning but also lower in the temperature of exausted gas, :thereby reducing the generation of poisonous substances such as nitrogen oxides and that of carbon.

Especially, in the present invention, metallic ions as catalyst are mixed into combustion air and operate in a different manner from the conventional cases where mixed into fuels, which difference permits a great amount of catalysts to be introduced into the combustion chamber, thus enhancing the catalytic effect still more.

Further, because of consisting only of a casing, permanent magnets, supporting shafts, and first and second cylindrical members, the present invention has advantages in that an inventive device can has simple structure, be produced at low cost and installed easily, and can permanently keep up an effect stable.

PREFERRED EMBODIMENTS OF THE INVENTION

The invention will now be described in details referring to the accompanying drawings illustrating its individual embodiments.

Figure 1:
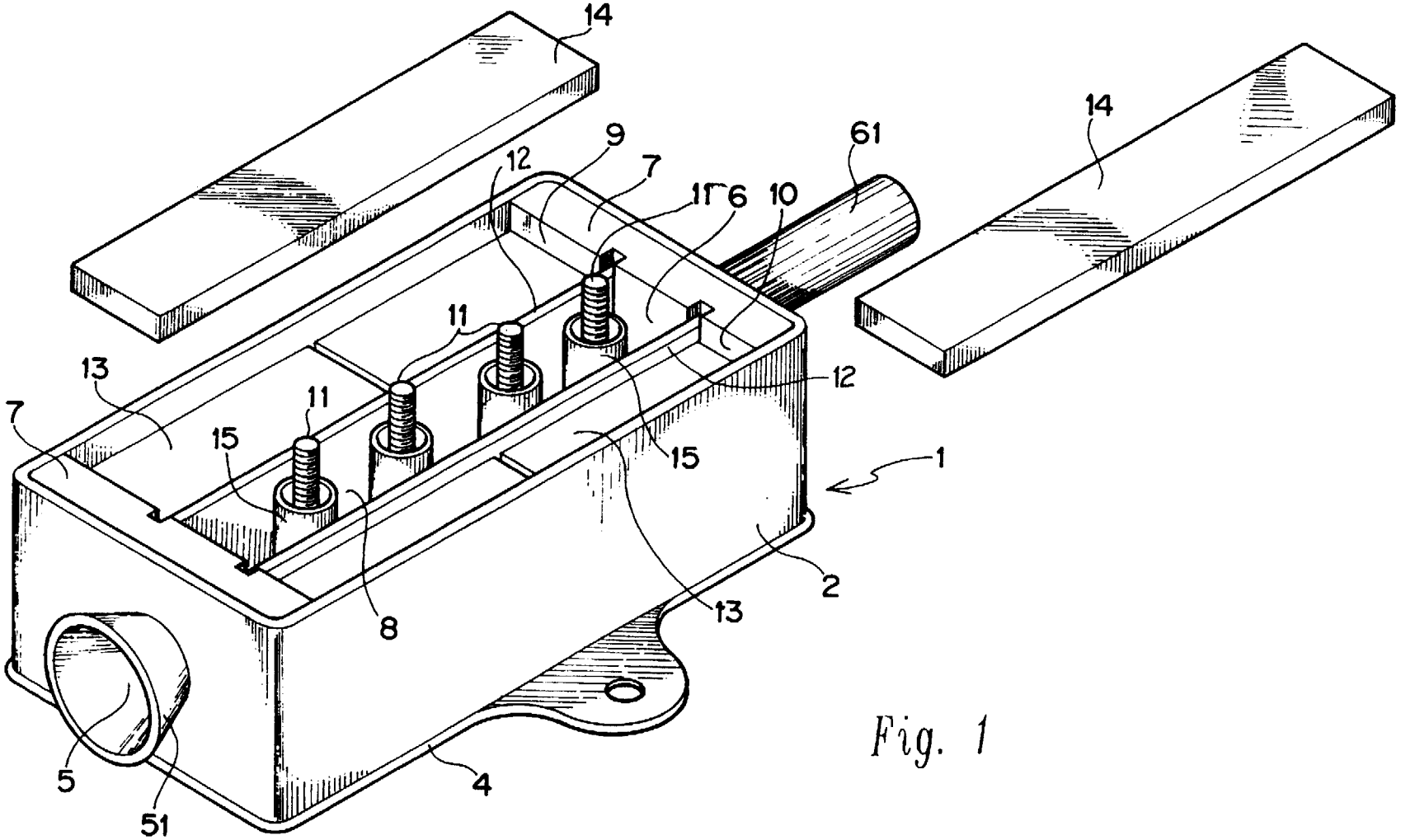
FIG. 1 is a perspective view of a device according to one embodiment of the present: invention with the top plate and the first cylindrical members taken off.
Figure 2:
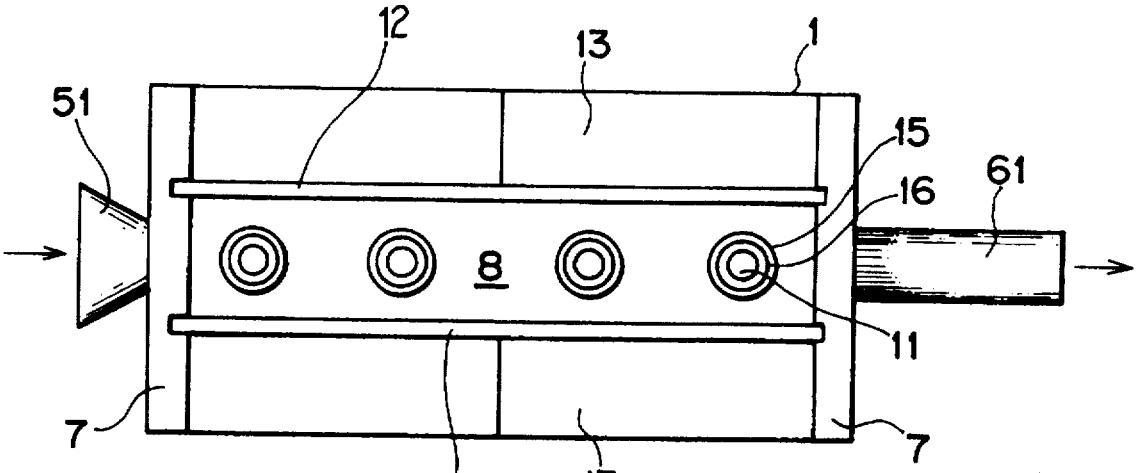
FIG. 2 is a plan view of the device of FIG. 1 with the first cylindrical members inserted.
Figure 3:
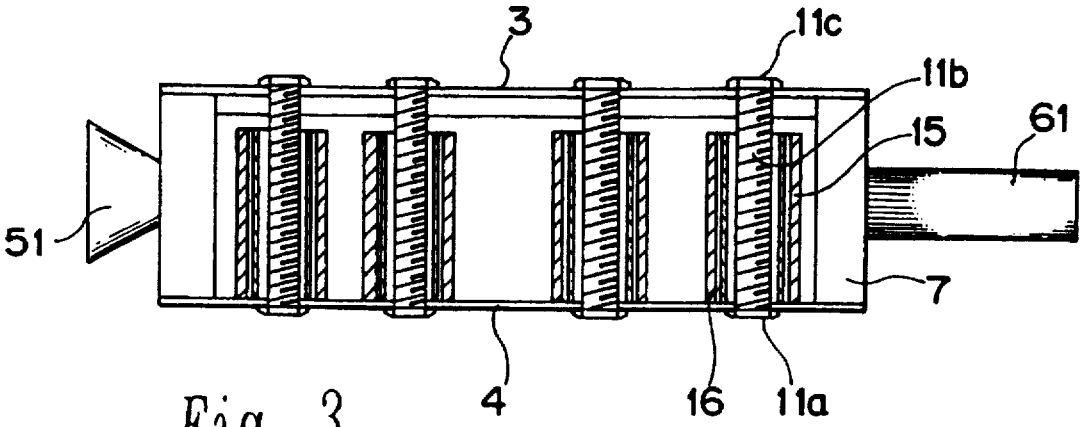
FIG. 3 is a sectional view of the device of FIG. 2 with the top plate attached.

FIGS. 1 to 3 show the schema of a device according to the present invention.

As shown FIGS. 1 to 3, a casing 1, made of magnetic materials, comprises a peripheral wall 2 left open up-, down-, and inward, and a top, plate 3 (FIG. 3) and a bottom plate 4 enclosing the two open planes for the peripheral walls 2, and takes a shape of a generally rectangular box by fixedly fastening the top and bottom plates 3, 4.

The inlet 5 of combustion air is formed on one end face of the peripheral wall 2, while on the other end face the outlet 6. A funnel-like inflow pipe 51 (with a large-diameter outer end) is attached outside the inlet 5, while outside the outlet 6 the outflow pipe 61 made up of an ordinary pipe.

A pair of magnetic shields 7, formed of wood, rubber, or like material, are placed inside the inlet 5 and the outlet 6. The casing interior space between the front and the back magnetic shields 7, 7 is transversely partitioned into three chambers 8, 9, 10 as shown in FIG. 1. The middle space 8 is constructed as air duct communicating the inlet 5 with the outlet 6, while the right and left spaces 9, 10 are bordered by the respective partition walls 12 made of aluminum plate and constitute magnet loading chambers.

Fixed in the magnet loading chambers 9, 10 are permanent magnets 13, both of which have the surfaces directed toward the air duct 8 being of the same mutually repelling poles. Onto the top and the bottom of the magnet loading chambers 9, 10 are detachably attached other magnetic shields 14. Thus, magnetic shielding substances cover the top and bottom, the front and back of the magnet loading chambers 9, 10, in each of which the inner side face toward the air duct chamber 8 is covered with the partition wall 12 made of magnetic permeable substances and the outer side face directly with peripheral casing wall 2. Permanent magnets 13 to be used are preferably of strongmagnetic force, e.g. on the order above 1,000 gauss.

Into and through the air duct 8, the supporting shaft 11 is inserted from the bottom plate 4 to the top plate 3. In the present embodiment, four supporting shafts 11 consist of bolts made of magnetic materials and are spaced in a direction of air flow. The bolts 11 have their heads 11*a* (FIG. 4) engaged in through holes formed on the bottom plate 4 and their shafts 11*b* passed up- and downward through the air duct 8, with the shaft-ends passing through holes on the top plate 3 of the casing I and secured with nuts 11*c*(FIG. 3).

Around each bolt 11, a second cylindrical member 15 made of strong positive ionization tendency metal, e.g. aluminum, is inserted so loosely as to freely move in the radial, peripheral, and axial directions of the bolt 11. Inside the second cylindrical member 15 is inserted a first cylindrical member 16 made of strong negative ionization tendency metals, e.g. either platinum group elements, such as platinum, palladium, and rhodium, or silver (FIGS. 2 and 3). This first cylindrical member 16 is wound with a thin sheet made of such metals as mentioned above in such a degree to become a little smaller in diameter than the second cylindrical member 15 and fitted loosely around the shaft of said bolt 11. Needless to say, it may be in advance shaped with one of these metals in pipe. Between the outer surface of a first cylindrical member 16 and that of a second cylindrical member 15, a certain space is formed.

Both first and second cylindrical members 15, 16 are formed with light-weight metals mutually different in ionization tendency, freely moved along the bolt shaft portion 11*b*by the flow of combustible air passing through the air duct 8, and charged by electromagnetic interaction due to this movement within the magnetic field. The outer surface of a first cylindrical member 16 and the inner one of a second cylindrical member 15 are charged into mutually opposed electricity. When the space between both of them comes within a pre-determined distance during fluctuation of both members 15, 16, an instantaneous discharge occurs between both, thereby converting oxygen in combustion air into nascent oxygen, at the time of which ionized particles generated from metals of the first and second cylindrical members 15, 16 are simultaneously mixed into combustion air.

Incidentally, first cylindrical members 16 to be inserted through four supporting shafts 11 may be constructed from the same metal, but those made of different metals may be disposed in consideration of types and other conditions of fuels. For example, a combination of platinum, palladium, and silver for gasoline engine and a combination of platinum and palladium for diesel engine is preferable.

Figure 4:
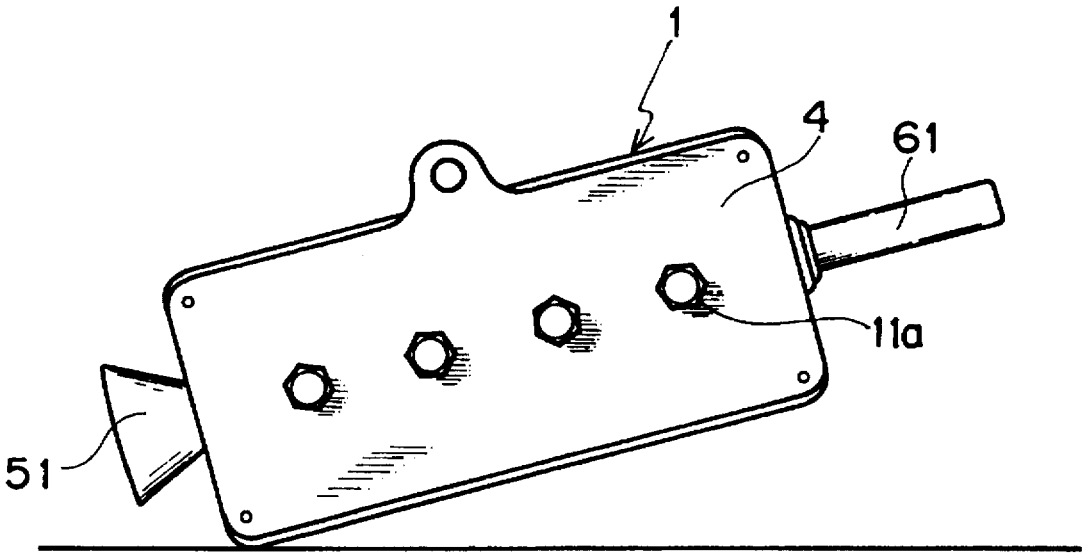
FIG. 4 shows the angle of attachment of a device according to the embodiment.

The device can be easily assembled by incorporating all member components in the interior of the bottom plate 4 and the peripheral wall 2, putting the top plate 3 on the top thereof, and tightening nuts on the top of bolts 11. As shown in FIG. 4, the present device assembled thus is fixed slantly at a desired position halfway in the suction duct of combustion air so that the supporting shafts 11 are directed horizontally and the end face on the outlet 6 side may come above the end face on the inlet 5 side. The slant degree is set to e.g. 15 to 20 degree so that both cylindrical members 15, 16 mentioned above might move as freely as possible by air flow around the supporting shaft 11.

Figure 5:
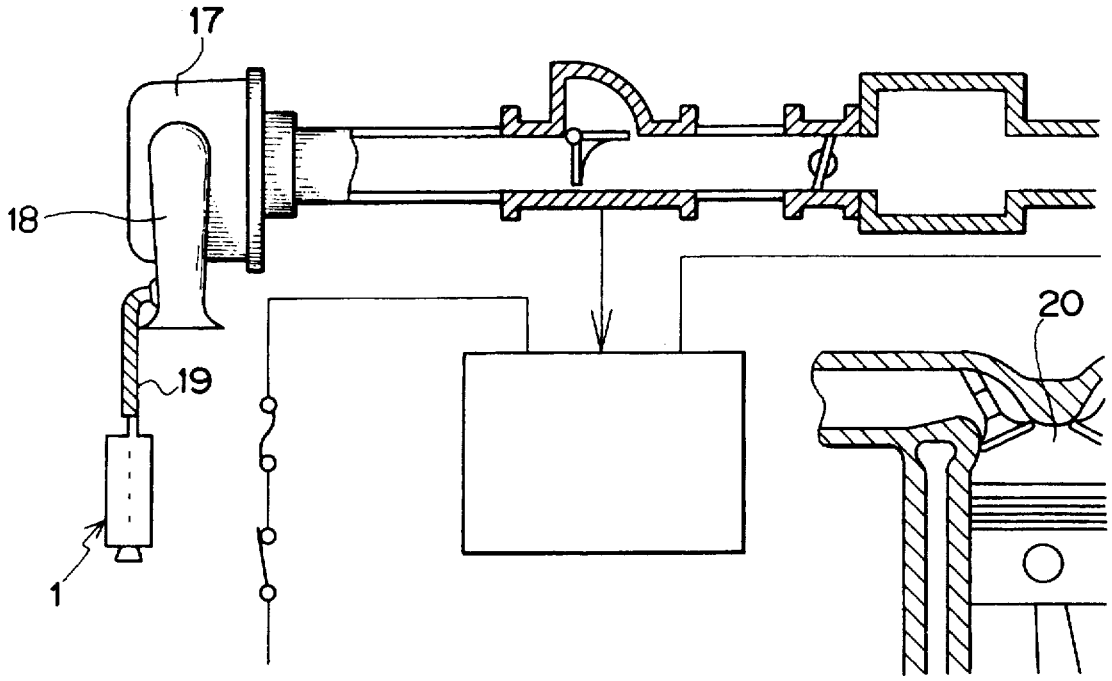
FIG. 5 is to illustrate one example of the mounting position of a device according to the embodiment.
Figure 6:
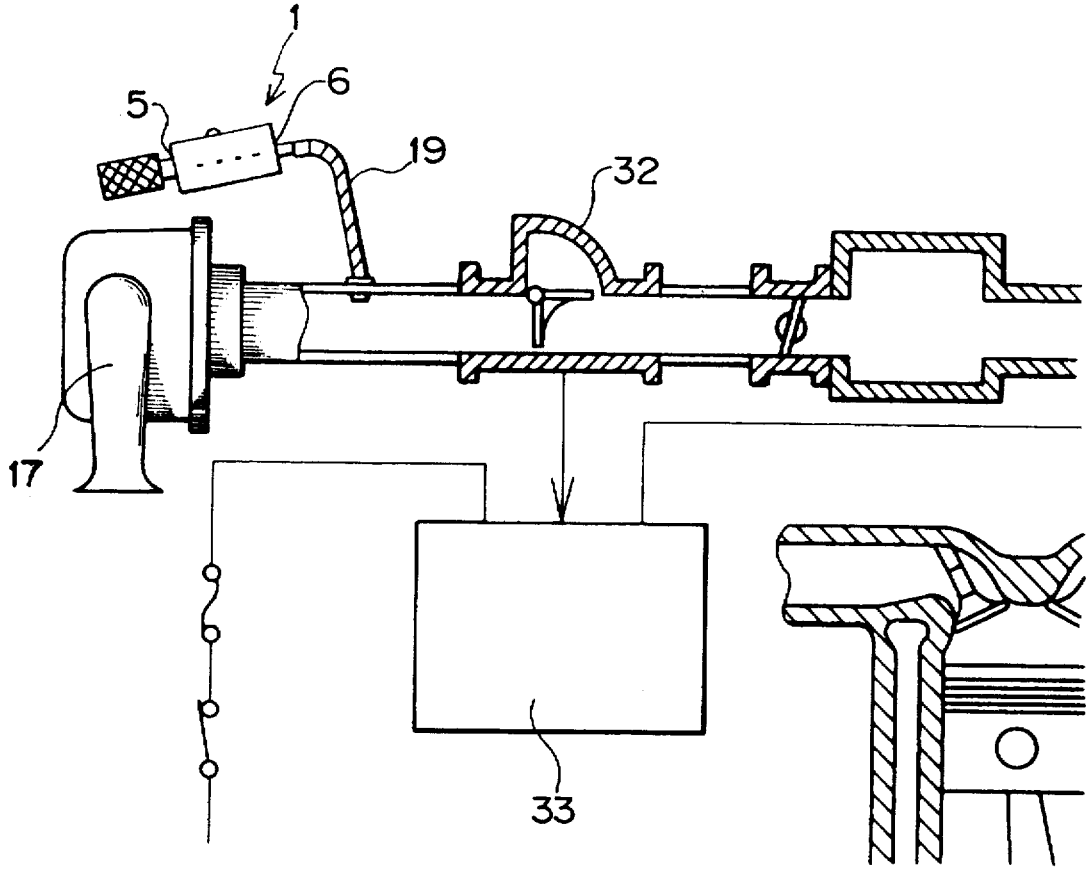
FIG. 6 is to illustrate another example of the mounting position of a device according to the embodiment.
Figure 7:
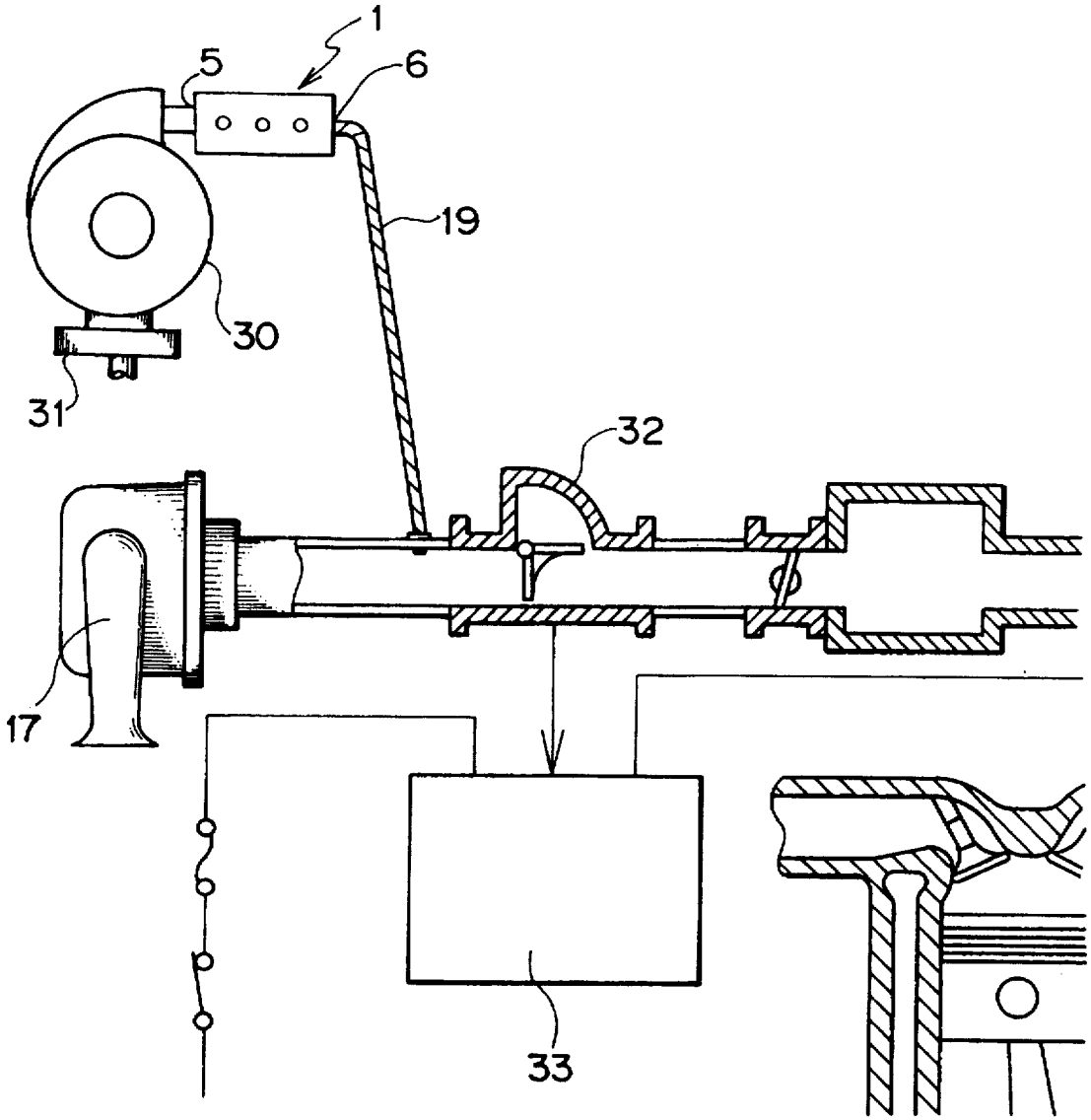
FIG. 7 is to illustrate the mounting position of device according to another embodiment of the present invention.

FIGS. 5 to 7 illustrate the attaching position at which the present device is attached into the air suction duct of an engine for automobiles. As shown in FIG. 5, for example, this device has a hole drilled in the frontal duct 18 of air cleaner 17 and connects through a tube 19 to the outlet 6 of the casing 1 with the metal connector tube attached to the hole. Alternatively, as shown in FIG. 6, the device may be attached at a position nearer to the combustion chamber 20 (designation in FIG. 5) than that of the air cleaner 17, when another filter is placed on the inlet 5 of a casing 1. In FIG. 6, Numerals 32 and 33 denote a air flow meter and fuel injection control circuit, respectively.

FIG. 7 shows another embodiment of the present invention, where a motor fan 30 for compulsory feeding is attached on the inlet side of the present device casing 1 and equipped with a purification filter 31 for air to be taken in the fan 30. During idling (at the engine revolution, e.g. 1,200 to 1,300 rpm), the motor fan 30 is driven on receipt of a signal from the engine control part to compulsorily feed a large amount of air into the inventive device. Incidentally, same numerals are put on the same members as with said embodiment and description thereabout will be omitted.

According to this embodiment, a necessary and sufficient amount of improved combustion air is fed even during idling, thereby especially inhibiting the adverse phenomena such as nitrogen oxides that are said to be generated in a great amount during idling. Next, Table 1 shows the test results found in the application of the present invention to quality improvement of combustion air in engine for cars.

TABLE 1

| | | | |
|---|---|---|---|
| Carbon monoxide | Co | 28.51 g/km | 7.74 g/km |
| Hydrocarbon | HC | 1.89 g/km | 0.69 g/km |
| Nitrogen oxides | NOx | 0.58 g/km | 0.38 g/km |
| Carbon dioxide | CO2 | 190.6 g/km | 207.0 g/km |
| Fuel expenses | | 1/9.8 km | 1/10.7 km |

In Table 1, results on an exhausted gas test and fuel expenses in 10 km travel were obtained after approx. 300 km travel without loading a device according to the present invention and after 60 km travel on loading an inventive device according to the embodiments as set forth in FIGS. 1 to 5, respectively. Using an automatic car of TOYOTA CARINA 1,800 cc and without adjustment of ignition timing after loading an inventive device, the test was carried out. As is evident from Table 1, the loading of an inventive device is revealed to improve the fuel expenses by about 10% and reduces CO, HC, and NOx by about 73%, about 63.5%, and about 34.5%, respectively, so that the effect has been proved significant.

TABLE 2

| ITEMS | BEFORE LOADING | AFTER LOADING |
|---|---|---|
| Graphite | 45% | 33% |
| Nitrogen Oxides | 120 ppm | 95 ppm |

Table 2 shows test results found in application of the present invention to diesel engine cars. In Table 2, the proportional content of carbon and nitrogen oxides in exhausted gas before and after loading are expressed in % and ppm, respectively, where data after loading are of 200 km travel after the loading the present device.

In this example, the effect of the present invention has also been proved significant.

I claim:

1. A combustion air quality improving device for internal combustion engines or general combustion equipment, comprising a casing made of magnetic materials in a shape of a relatively elongated box having end faces provided with an air inlet on one end face and an outlet on the other end face in the longitudinal direction, said casing having an air duct communicating said inlet with said outlet formed inside thereof, and being fixed so as to have said air outlet connected to an intermediate point of the suction air duct for combustion air in internal combustion engines or general combustion equipment, said casing further including permanent magnets disposed in such a manner that the same poles are opposed to each other with said air duct sandwiched therebetween, shaft members made of magnetic materials being transversely disposed in said air duct, first cylindrical members made of metals being fitted loosely around the shaft members, and second cylindrical members made of metals different in ionization tendency from those of said first cylindrical members being fitted loosely around the outer periphery of respective first cylindrical members with a gap therebetween whereby said first and second cylindrical members, different in ionization tendency from each other, are rotatably moved around said shaft members with aid of the air flow passing from said inlet through the air duct to said outlet.

2. A combustion air quality improving device for internal combustion engines or general combustion equipment, comprising a casing made of magnetic materials in a shape of a relatively elongated box having end faces provided with an air inlet on one end face and an outlet on the other end face in the front-to-back direction, having an air duct communicating said inlet with said outlet formed inside thereof, and being fixed so as to have said air outlet connected to an intermediate point of the suction air duct for combustion air in internal combustion engines or general combustion equipment, said casing further including permanent magnets disposed in such a manner that the same poles are opposed to each other with said air duct sandwiched therebetween, shaft members made of magnetic materials being transversely disposed in said air duct, first cylindrical members made of metals being fitted loosely around the shaft members, second cylindrical members made of metals different in ionization tendency from those of said first cylindrical members being fitted loosely around the outer periphery of respective first cylindrical members with a certain gap kept therebetween, and a fan motor attached to the air duct on the side of inlet in said casing, whereby said first and second cylindrical members, different in ionization tendency from each other, are rotatably moved around said shaft members due to the air flow passing from said inlet through the air duct to said outlet, and said fan motor being controlled so as to be driven during idling of an internal combustion engine.

3. A combustion air quality improving device for internal combustion engines or general combustion equipment as claimed in any one of claims 1 and 2, in which slantwise fixation of said casing at an intermediate point in the suction duct of combustion air for internal combustion engines or general combustion equipment is such that the end face on said outlet side may come above the end face on said inlet side.

4. A combustion air quality improving device for internal combustion engines or general combustion equipment as claimed in any one of claims 1 and 2, in which a magnetic shielding material covers all the surfaces of permanent magnets loaded in said casing other than the surfaces facing and opposed to said air duct thereof.

5. A combustion air quality improving device for internal combustion engines or general combustion equipment as claimed in any one of claims 1 and 2, in which each of said first cylindrical members is made of platinum group metals, such as platinum and palladium, and each of said second cylindrical members is made of aluminum.

6. A combustion air quality improving device for internal combustion engines or general combustion equipment as claimed in any one of claims 1 and 2, in which each of said first cylindrical members is made of silver, and each of said second cylindrical members is made of aluminum.

7. A combustion air quality improving device for internal combustion engines or general combustion equipment as claimed in any one of claims 1 and 2, in which a plural number of said shaft members are disposed with a space left therebetween in the front-to-back direction of the air duct.

8. A combustion air quality improving device for internal combustion engines or general combustion equipment as claimed in any one of claims 1 and 2, in which said casing includes top and bottom plates, said shaft members consist of bolts to connect said plates.

* * * * *